US010520877B2

(12) United States Patent
Kawaguchi

(10) Patent No.: US 10,520,877 B2
(45) Date of Patent: Dec. 31, 2019

(54) IMAGE FORMING APPARATUS INCLUDING A COVER AND A COVER SUPPORT

(71) Applicant: CANON KABUSHIKI KAISHA, Tokyo (JP)

(72) Inventor: Hiroshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/180,976

(22) Filed: Nov. 5, 2018

(65) Prior Publication Data

US 2019/0146406 A1 May 16, 2019

(30) Foreign Application Priority Data

Nov. 10, 2017 (JP) ..... 2017-217750
Oct. 17, 2018 (JP) ..... 2018-195911

(51) Int. Cl.
*G03G 21/16* (2006.01)

(52) U.S. Cl.
CPC ..... *G03G 21/1633* (2013.01); *G03G 21/1647* (2013.01)

(58) Field of Classification Search
CPC ..... G03G 21/1633; G03G 21/1647
See application file for complete search history.

(56) References Cited

U.S. PATENT DOCUMENTS

2008/0201904 A1* 8/2008 Salice ..... E05D 11/1021 16/319

FOREIGN PATENT DOCUMENTS

| | | | |
|---|---|---|---|
| JP | 2003-87464 | A | 3/2003 |
| JP | 2004-45585 | A | 2/2004 |
| JP | 2017-3892 | A | 1/2017 |

* cited by examiner

*Primary Examiner* — Susan S Lee
(74) *Attorney, Agent, or Firm* — Canon U.S.A. Inc., IP Division

(57) ABSTRACT

An image forming apparatus includes a cover support portion openably and closably supporting the cover on the image forming apparatus. The cover support portion includes a clamping portion and a pressure member. The clamping portion is configured to contact and clamp part of the cover or part of the cover support portion in a turning radius direction of the cover. The pressure member is mounted to the clamping portion to press the clamping portion.

11 Claims, 22 Drawing Sheets

IMAGE FORMING APPARATUS INCLUDING A COVER AND A COVER SUPPORT

BACKGROUND OF THE INVENTION

Field of the Invention

The present disclosure relates to image forming apparatuses for forming an image on a recording medium, such as a transfer material, a print sheet, photosensitive paper, or an electrostatic recording sheet. In particular, the present disclosure relates to an image forming apparatus including a cover that can be opened or closed with respect to the image forming apparatus.

Description of the Related Art

In an image forming apparatus, an improvement in the user operability of the opening and closing cover is sometimes a challenge. In other words, high rigidity of the cover, a good feel in operating the cover, and a good feeling in an opening or closing operation may be required. Among them, in the cover opening operation, the cover can swing open, or the opened door can bounce to decrease the quality feeling of the apparatus.

For those reasons, known image forming apparatuses in the art have a braking mechanism that exhibits their effects according to the cover opening or closing operation to improve the operational feeling in opening or closing the opening and closing cover.

An example configuration is illustrated in FIG. 21A in which a cover-side protrusion is made to interfere with a link member that restricts the opening of the cover to brake the opening operation (Japanese Patent Laid-Open No. 2003-87464). As illustrated in FIGS. 21B and 21C, the width of the gap in the link member is set smaller than the outside diameter of the protrusion to thereby brake the opening operation.

Another example illustrated in FIGS. 20A and 20B is a braking mechanism using a damper, in which reduction in speed using a gear train is combined to produce a high torque (Japanese Patent Laid-Open No. 2017-3892). Still another example is illustrated in FIGS. 22A to 22C, in which a damper unit applies a pressing load to part of the cover in a direction perpendicular to the direction of the turning radius of the cover (Japanese Patent Laid-Open No. 2004-45585).

However, in the configuration disclosed in Japanese Patent Laid-Open No. 2003-87464, the braking force is produced by the interference between the resin components. Therefore, a large braking force may damage the components. Therefore, this configuration cannot give a sufficient braking force to a large, heavy cover.

The braking mechanism disclosed in Japanese Patent Laid-Open No. 2017-3892 produces a high torque using the damper and the gear train but needs a large space for the braking mechanism and high cost.

The configuration disclosed in Japanese Patent Laid-Open No. 2004-45585 requires a large damper to exhibit a sufficient damper function.

SUMMARY OF THE INVENTION

The present disclosure provides an image forming apparatus including a cover configured to be opened or closed by rotating with respect to the image forming apparatus and a cover support portion openably and closably supporting the cover on the image forming apparatus. The cover support portion includes a clamping portion and a pressure member. The clamping portion is configured to contact and clamp part of the cover or part of the cover support portion in a turning radius direction of the cover. The pressure member is mounted to the clamping portion to press the clamping portion.

Further features of the present disclosure will become apparent from the following description of exemplary embodiments with reference to the attached drawings.

DESCRIPTION OF THE EMBODIMENTS

Embodiments of the present disclosure will be described hereinbelow in detail with reference to the drawings. It is to be understood that the components described in the embodiments are given for mere illustrative purposes, and the scope of the present disclosure is not limited to the embodiments.

First Embodiment

Figure 1:
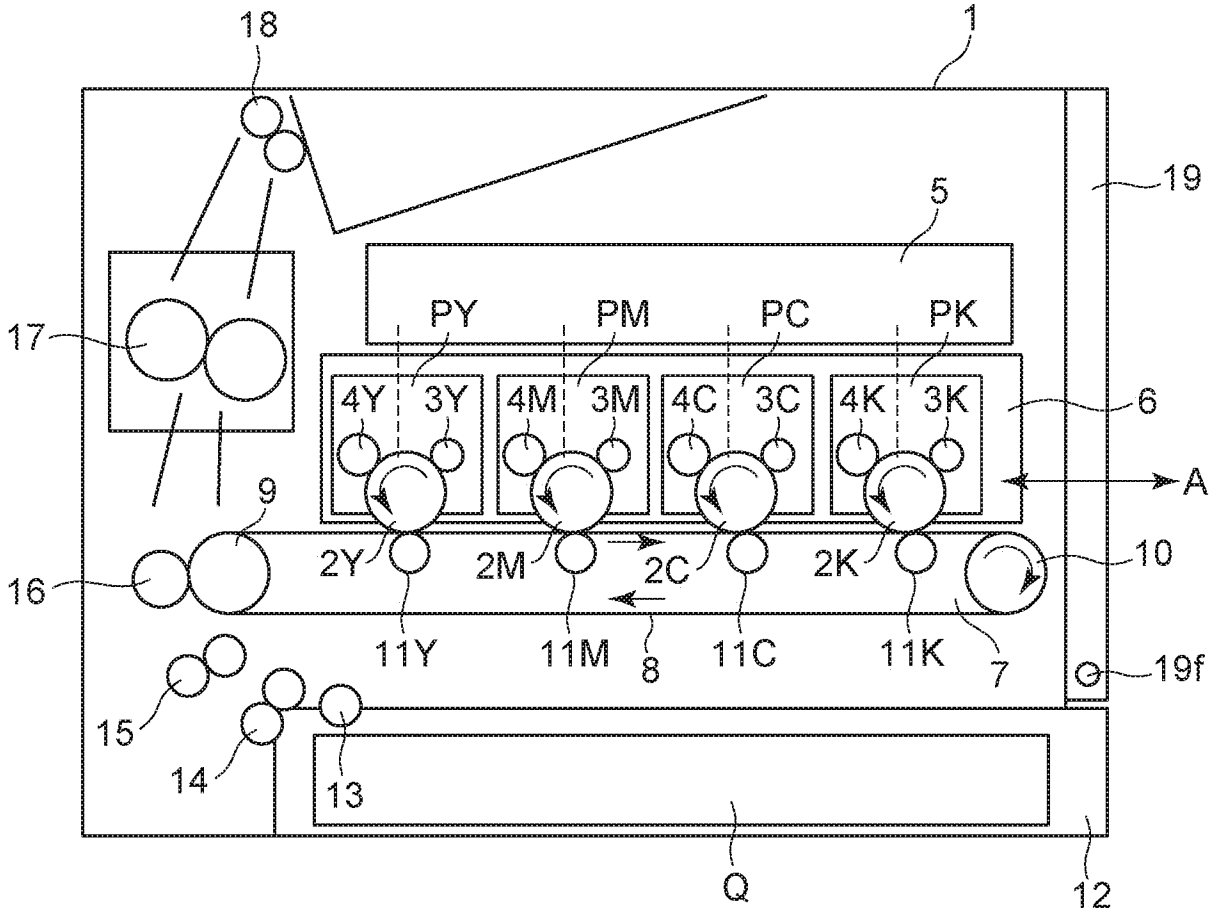
FIG. 1 is a cross-sectional view of an image forming apparatus according to a first embodiment of the present disclosure.

FIG. 1 is a diagram of an example of an image forming apparatus according to a first embodiment illustrating, in outline, the configuration of a four-drum full-color image forming apparatus using an intermediate transfer belt among electrophotographic image forming apparatuses.

In FIG. 1, reference sign 1 denotes the main body of a four-drum full-color image forming apparatus which is an electrophotographic full-color laser beam printer. Photosensitive drums 2Y, 2M, 2C, and 2K are image bearing members that respectively carry developer images (toner images) developed with yellow (Y), magenta (M), cyan (C), and black (K) developers (toners). The photosensitive drums 2Y, 2M, 2C, and 2K are respectively rotatably supported at both ends by process cartridges PY, PM, PC, and PK. The photosensitive drums 2Y, 2M, 2C, and 2K receive driving at one end from a drive motor in the image forming apparatus via a driving transmission unit, such as a gear. The photosensitive drums 2Y, 2M, 2C, and 2K are driven to rotate counterclockwise in FIG. 1. The process cartridges PY, PM, PC, and PK are detachably mounted to the main body 1 of the image forming apparatus using a cartridge tray 6.

In an image forming process, first, the surfaces of the photosensitive drums 2Y, 2M, 2C, and 2K having an organic photoconductive layer are respectively uniformly charged by charging rollers 3Y, 3M, 3C, and 3K. Thereafter, the photosensitive drums 2Y, 2M, 2C, and 2K are selectively exposed to a laser beam emitted from a laser scanner 5 to form electrostatic latent images.

These electrostatic latent images are provided with toners, which are color developers, by developing units 4Y, 4M, 4C, and 4K and are developed as toner images on the photosensitive drums 2Y, 2M, 2C, and 2K.

An intermediate transfer belt unit 7 includes an intermediate transfer belt 8 stretched across a driving roller 9 and a driven roller 10. Primary transfer rollers 11Y, 11M, 11C, and 11K are driven while being in contact with the photosensitive drums 2Y, 2M, 2C, and 2K with the intermediate transfer belt 8 therebetween. The intermediate transfer belt 8 is rotationally driven clockwise in FIG. 1 as the driving roller 9 is rotated by receiving driving from the drive motor via a drive transmission unit, such as a gear.

A predetermined transfer bias is applied to the primary transfer rollers 11Y, 11M, 11C, and 11K, and color toner images on the surfaces of the photosensitive drums 2Y, 2M, 2C, and 2K are layered in sequence on the intermediate transfer belt 8 to form a four-color toner image.

A sheet cassette 12 contains transfer materials Q (recording media), such as plane paper or heavy paper. The transfer materials Q are fed by a feed roller 13. Thereafter, each transfer material Q passes through a conveying roller pair 14 and a registration roller pair 15 and is conveyed to a secondary transfer position at which the intermediate transfer belt 8 and a secondary transfer roller 16 are in contact. At the secondary transfer position, the four-color toner image on the intermediate transfer belt 8 is transferred onto the transfer material Q by the secondary transfer roller 16 to which a predetermined bias is applied.

The transfer material Q to which the four-color toner image is transferred is conveyed to a fixing roller pair 17, where the toner image is melted and fixed onto the transfer material Q by heat and pressure to form a color image on the transfer material Q. The transfer material Q conveyed by the fixing roller pair 17 passes through a discharge roller pair 18 and is discharged and stacked onto an output tray.

Figure 3:
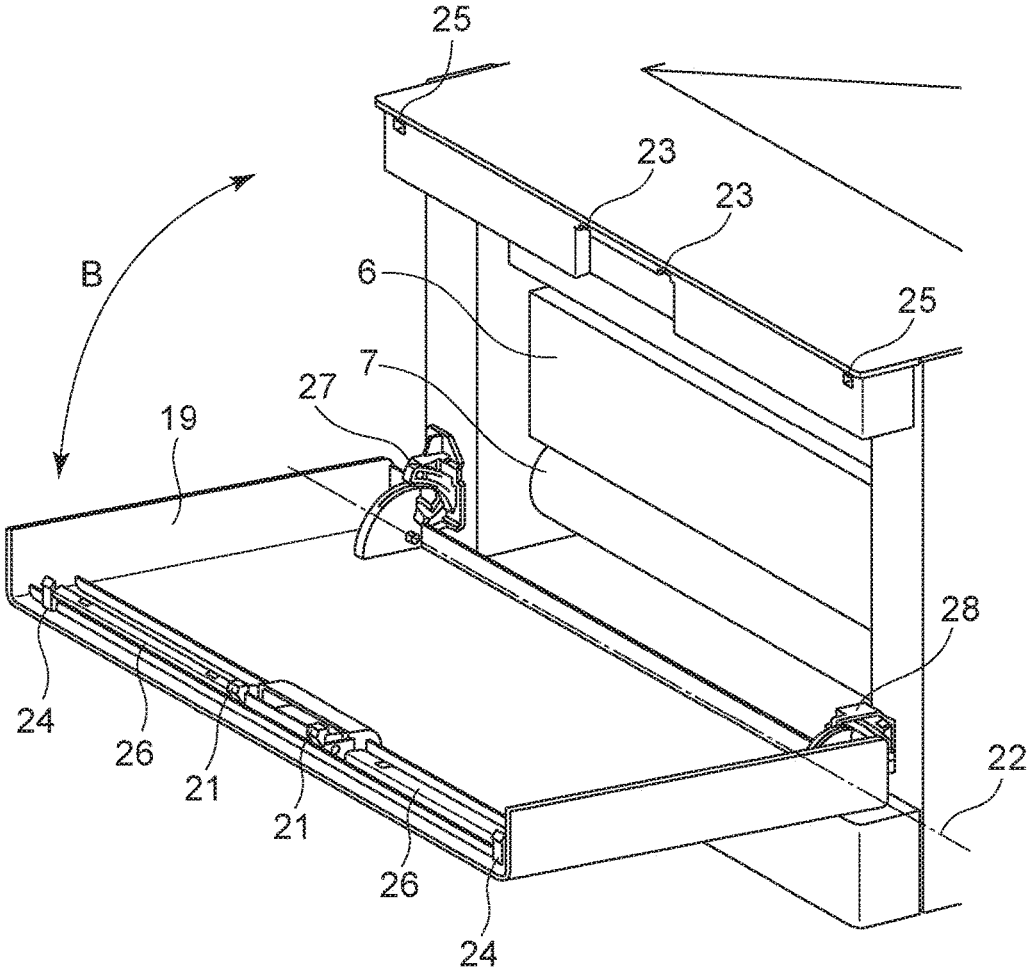
FIG. 3 is a diagram illustrating a state in which an opening and closing door of the image forming apparatus according to the first embodiment is open.

The cartridge tray 6 and the intermediate transfer belt unit 7 can be mounted and demounted in the direction of arrow A in FIG. 1 by opening and closing an opening and closing door 19, which is an openable cover disposed on the apparatus main body 1. The opening and closing door 19 (an openable cover) rotates about a rotation center 19*f* to open the interior of the image forming apparatus, allowing the cartridge tray 6 and the intermediate transfer belt unit 7 to be drawn from the interior of the image forming apparatus. FIG. 1 illustrates a state in which the opening and closing door 19 is closed. FIG. 3 illustrates a state in which the opening and closing door 19 is open.

Figure 2:
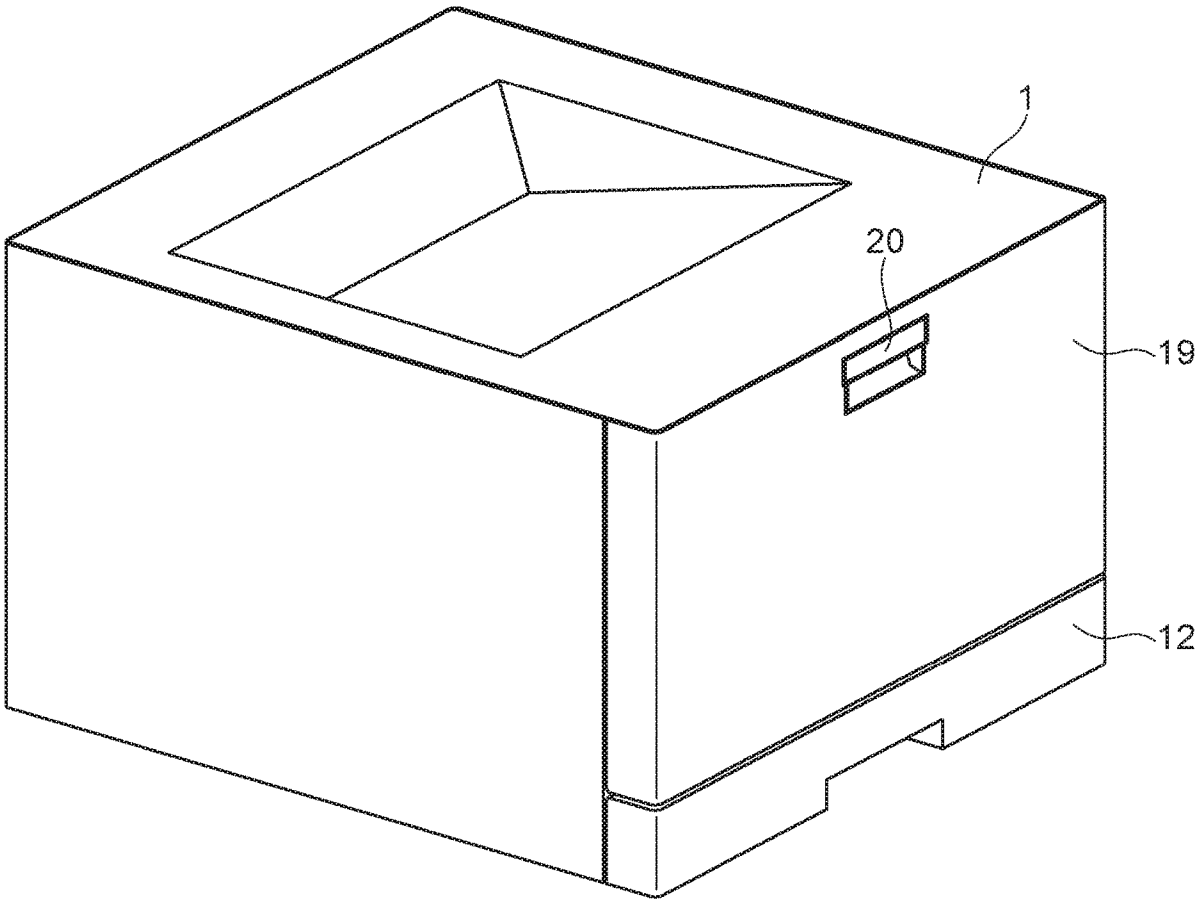
FIG. 2 is a perspective view of the image forming apparatus according to the first embodiment.

FIG. 2 is a perspective view of the image forming apparatus according to the first embodiment.

The opening and closing door 19, which is a cover that can be opened or closed with respect to the image forming apparatus, can be opened or closed with respect to the main body of the image forming apparatus by operating a handle 20.

As illustrated in FIG. 3, the opening and closing door 19 can be opened or closed from the casing of the image forming apparatus by operating the handle 20, so that the interior of the image forming apparatus can be viewed. In this state, when replacing a process cartridge P in which toner has run out, the user can draw the cartridge tray 6 from the apparatus main body 1 and replace the process cartridge P.

As illustrated in FIG. 3, the opening and closing door 19 (an openable cover) is rotatably supported by first and second door hinges (left and right door hinges) 27 and 28 (cover support portions disposed in the image forming apparatus).

The opening and closing door 19 is supported by the cover support portions—the door hinge 27 on the left side and the door hinge 28 on the right side viewed from the front (with the opening and closing door 19 at the front)—so as to be rotatable about a rotation axis 22 indicated by the chain line in FIG. 3.

Two handle claws 21 of the handle 20 are disposed on the back of the opening and closing door 19. The handle claws 21 engage with engaging grooves 23 of the apparatus main body 1. Urging the handle 20 with an urging unit allows the opening and closing door 19 to be held in a closed state.

Claws 24 (engaging portions) are provided at two corners of the opening and closing door 19. The claws 24 engage with engaging holes 25 of the apparatus main body 1, thereby preventing an end of the opening and closing door 19 from being separated from the apparatus main body 1 in a state in which the opening and closing door 19 is closed. The opening and closing door 19 also has metal stays 26 to prevent the claws 24 serving as engaging portions from not firmly engaging with the engaging holes 25 due to insufficient strength or warping of the opening and closing door 19.

Figure 4:
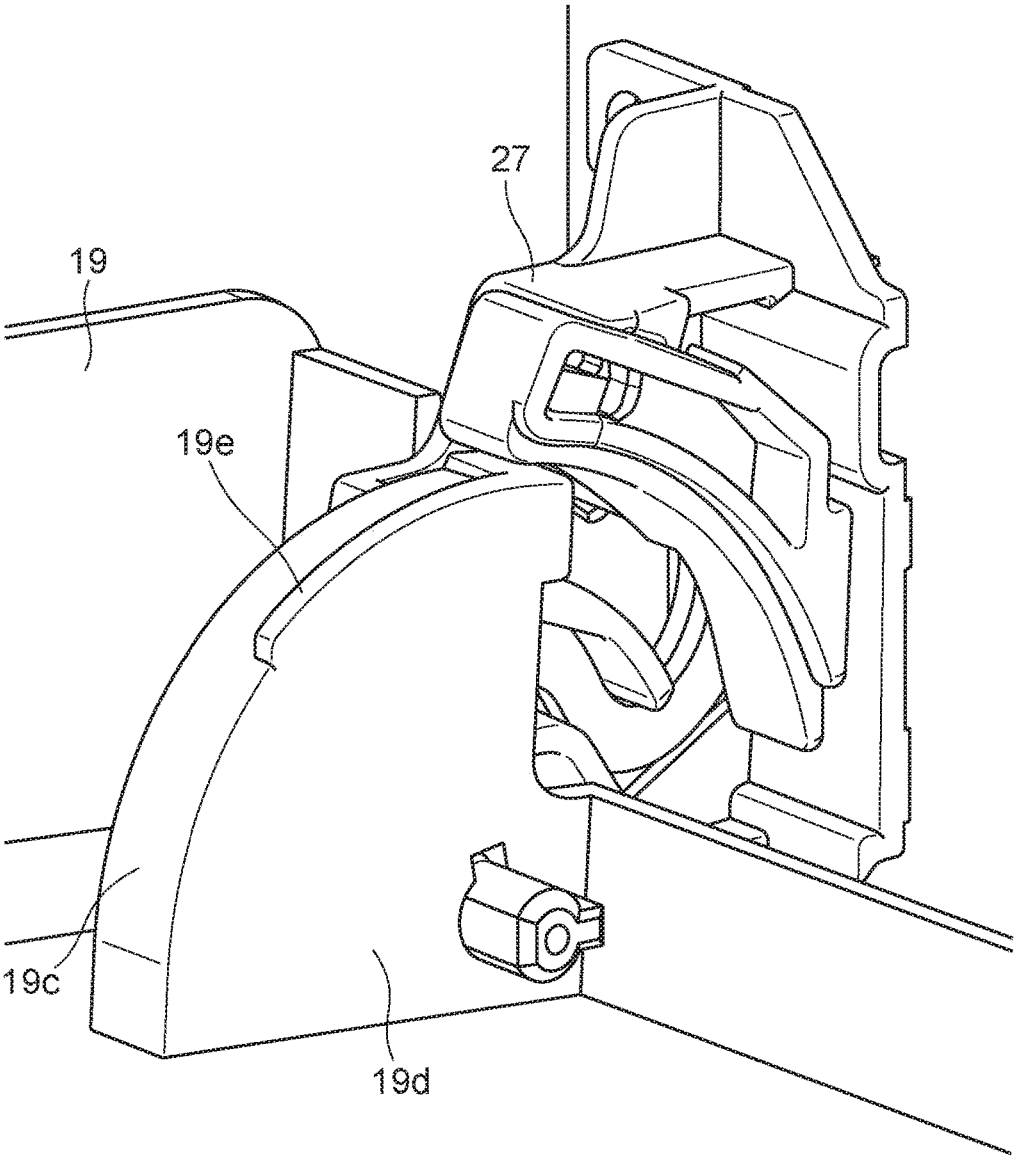
FIG. 4 is a detailed view of the periphery of a door hinge according to the first embodiment.

FIG. 4 illustrates the details of the periphery of the first door hinge (the left door hinge) 27.

The left door hinge 27 illustrated in FIG. 4 includes a braking mechanism for the opening and closing door 19. In the present embodiment, the right door hinge 28 illustrated in FIG. 3 includes no braking mechanism.

Figure 5:
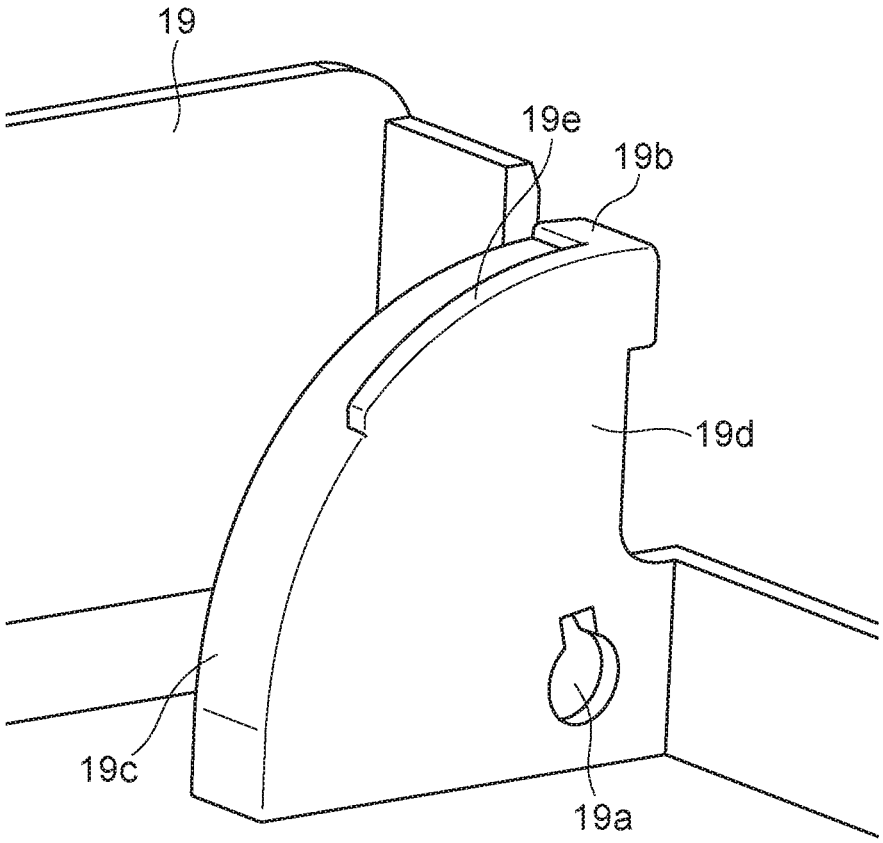
FIG. 5 is a diagram illustrating a portion of an opening and closing door engaging with the hinge of the opening and closing door according to the first embodiment.
Figure 6:
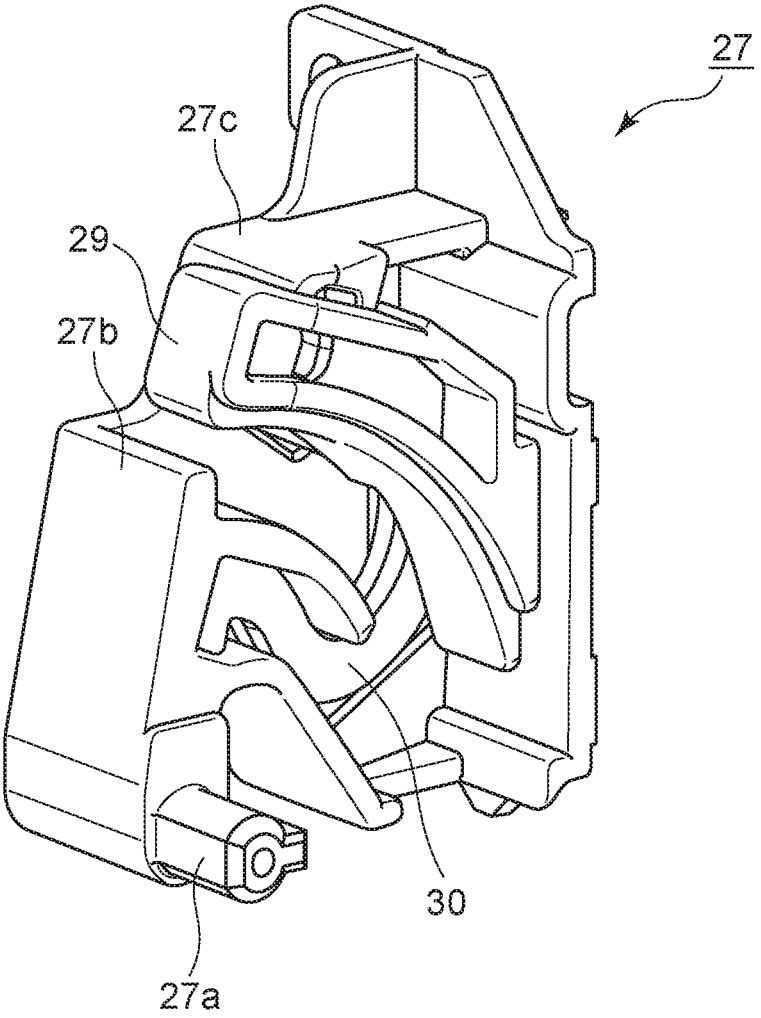
FIG. 6 is a detailed view of the door hinge according to the first embodiment.

The structure illustrated in FIG. 4 is divided into the opening and closing door 19 and the door hinge 27, which are respectively illustrated in FIG. 5 and FIG. 6.

FIG. 5 illustrates a portion of the opening and closing door 19 engaging with the left door hinge 27. A door-hinge left projection 27*a* (FIG. 6), which is part of the opening and closing door 19 (to be described later), engages with a hinge engaging hole 19*a* to rotatably support the opening and closing door 19.

The opening and closing door 19 includes a door protrusion 19*b*, which is pressed and clamped by a braking mechanism (to be described later) to provide resistance against the motion of the opening and closing door 19, thereby improving the operational feeling. The door protrusion 19*b* is part of the opening and closing door 19. Since the door protrusion 19*b* moves in contact with a clamping portion of the cover support portion to generate a braking action, the opening motion of the opening and closing door 19 is delayed. In addition to the door protrusion 19*b*, the opening and closing door 19 partly includes an arc-shaped first hinge cover 19*c* for covering the door hinge 27 and a second hinge cover 19*d* for covering the door hinge 27, the second hinge cover 19*d* having a hinge engaging hole 19*a*.

The opening and closing door 19 further partly includes an arc-shaped protrusion 19*e* having a circular surface along the direction of rotation of the opening and closing door 19. The arc-shaped protrusion 19*e* also has a structure for providing resistance to the motion of the opening and closing door 19 when moving in contact with the clamping portion of the cover support portion. Therefore, in the present embodiment, the clamping portion and the arc-shaped protrusion 19*e* start to contact from the state where the opening and closing door 19 is opened to 45° from the closed state (0°), so that the arc-shaped protrusion 19*e* pushes the upper part of the clamping portion upward. Against it, the pressure member applies pressure to the arc-shaped protrusion 19*e* via the clamping portion to generate a braking force. When the opening and closing door 19 is fully opened (90°), the arc-shaped protrusion 19*e* and then the door protrusion 19*b* come into contact with the clamping portion.

FIG. 6 illustrates the details of the left door hinge 27 (the cover support portion). The left door hinge 27 in the present embodiment includes four components, that is, a resin door hinge left frame 27*c*, two metal brake disks 30*a* and 30*b*, and a resin brake cover 29. In the present embodiment, the resin door hinge left frame 27*c* and the resin brake cover 29 constitute the clamping portion of the cover support portion. The clamping portion of the cover support is disposed so as to clamp the door protrusion 19*b*, which is part of the opening and closing door 19, in the direction of the turning radius of the opening and closing door 19. The first and second metal brake disks 30*a* and 30*b* are pressure members that apply pressure to the clamping portion of the cover support. The first and second brake disks 30*a* and 30*b* are in contact with a surface of the door hinge left frame 27*c* opposite to a surface of the door hinge left frame 27*c* in contact with the door protrusion 19*b* in the direction of the turning radius. The first and second brake disks 30*a* and 30*b* are in contact with a surface of the brake cover 29 opposite to a another surface of the brake cover 29 in contact with the door protrusion 19*b* in the direction of the turning radius.

Figure 7:
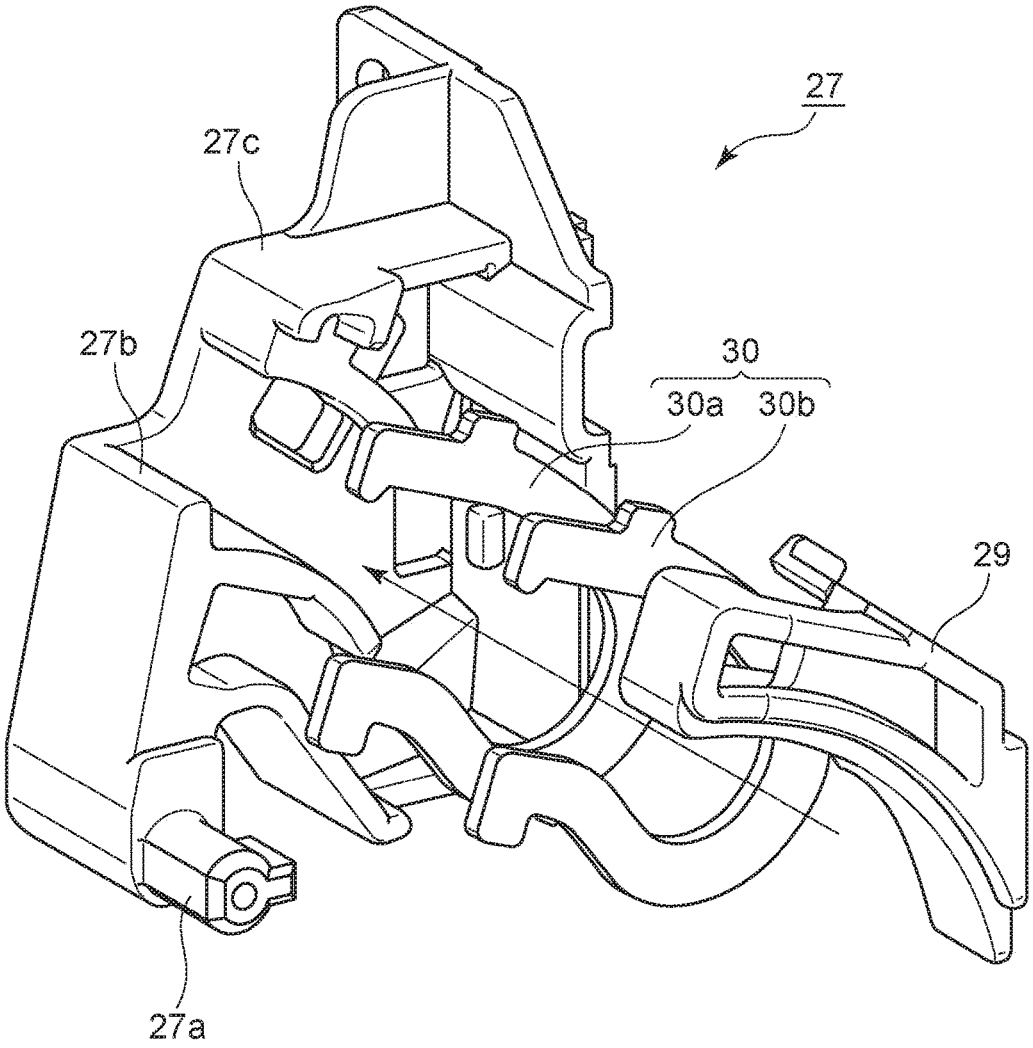
FIG. 7 is an exploded view of the door hinge according to the first embodiment.
Figure 8:
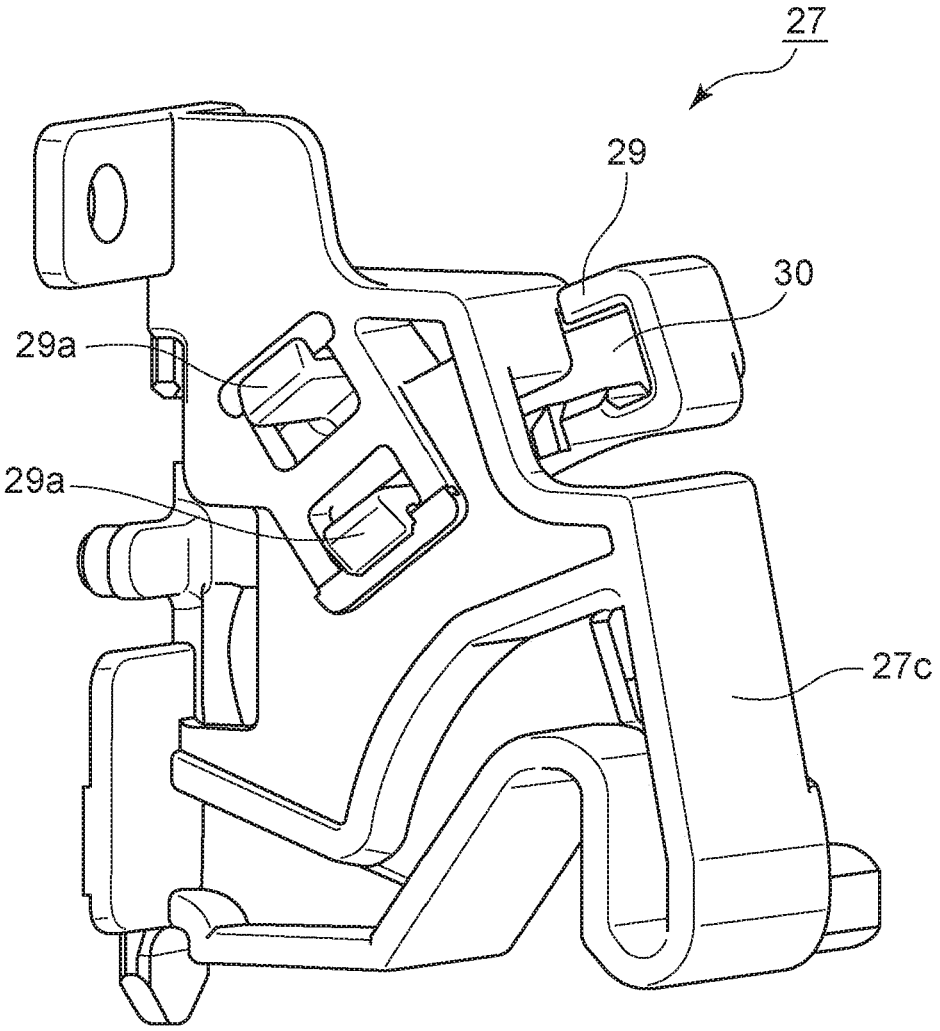
FIG. 8 is a detailed view of the door hinge according to the first embodiment.

FIG. 7 is an exploded view of the left door hinge 27. After the first and second brake disks 30*a* and 30*b* are mounted to the brake cover 29, the whole brake cover 29 is mounted to the door hinge left frame 27*c*. The brake cover 29 and the door hinge left frame 27*c* are disposed so as to clamp the brake disks 30*a* and 30*b* in the direction of the rotation axis 22 of the opening and closing door 19, with the four components mounted to the image forming apparatus. After the assembly, brake cover claws 29*a* illustrated in FIG. 8 engage with the holes of the door hinge left frame 27*c* to achieve retaining. The brake cover 29 is positioned not directly to the door hinge left frame 27*c* but via the brake disk 30.

The clamping portion of the door hinge 27 is thus constituted by two members—the door hinge left frame 27*c* (a first member) and the brake cover 29 (a second member), thereby remarkably reducing a stress acting on the clamping portion itself. Thus, a braking mechanism that exerts a large braking force against the door protrusion 19*b* can be provided.

Figure 9:
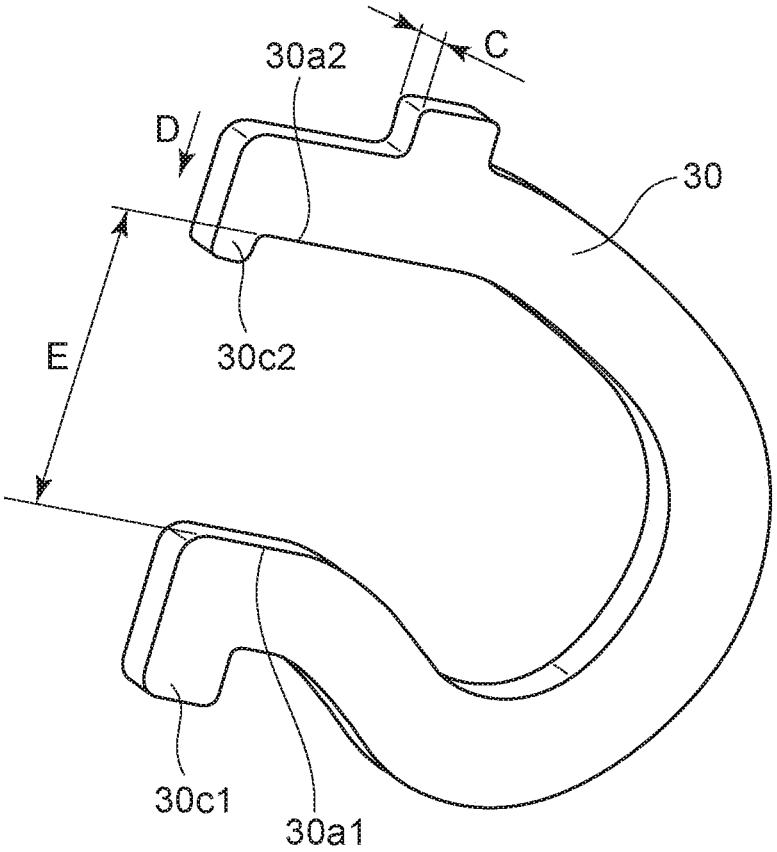
FIG. 9 is a diagram of a brake disk according to the first embodiment.

FIG. 9 illustrates the brake disk 30 formed of a metal plate. The brake disk 30 has a C-shape viewed in the direction of the rotation axis of the opening and closing door 19 mounted to the image forming apparatus (viewed from a plane perpendicular to the rotation axis). The brake disk 30 includes first and second opposing brake pressure units 30*a*1 and 30*a*2 at the ends. The brake disk 30 of the present embodiment further includes first and second protruding hooks 30*c*1 and 30*c*2 to be engaged with the cover support portion so as to move in conjunction with the cover support portion. The first hook 30*c*1 of the brake disk 30 is hooked such that the protrusion is fit in a recess of the door hinge left frame 27*c*. The second hook 30*c*2 of the brake disk 30 is hooked such that the protrusion is fit in a recess of the brake cover 29. The protrusions of the first and second hooks 30*c*1 and 30*c*2 protrude in a direction adjacent to the rotation center of the opening and closing door 19 (toward the rotation center), with the brake disk 30 disposed in the image forming apparatus. The first and second brake pressure units 30*a*1 and 30*a*2 of the brake disk 30 clamp the door protrusion 19*b* (part of the opening and closing door 19) in the direction of the rotation radius. The first and second brake pressure units 30*a*1 and 30*a*2 apply pressure to the door protrusion 19*b* in the direction of arrow D (a pressing direction) in FIG. 9 to generate a braking force between the door protrusion 19*b* and the clamping portion, thereby applying a brake to the motion of the opening and closing door 19. If the door protrusion 19*b* is directly clamped between the brake pressure units 30*a*1 and 30*a*2 of the brake disk 30, the sliding portions are prone to be damaged. For that reason, the door protrusion 19*b* is clamped via the resin door hinge left frame 27*c* and the resin brake cover 29, as illustrated in FIG. 6. Furthermore, the brake disk 30 (a pressure member) is mounted so as to come into contact with the resin door hinge left frame 27*c* and the resin brake cover 29.

Thus interposing members between the pressure member and the member to be braked reduces damage to the door protrusion or the clamping portion. This allows a mechanism that provides a sufficient braking force to be provided while saving the space.

The brake disk 30 is configured to be in contact with the portion of the door hinge left frame 27*c* in contact with the door protrusion 19*b* of the brake cover 29 from the outside and both sides in the direction of the turning radius.

The braking mechanism employed in the first embodiment is constituted by only the periphery of the door hinge 27 so as to look well even with the door opened (in a door opened state). In other words, it is necessary to provide a large pressing, clamping force to apply a brake in the vicinity of the fulcrum of the rotation (or the turning fulcrum) of the opening and closing door 19. Furthermore, since the braking mechanism is composed only by the periphery of the door hinge 27, the appearance can be enhanced by hiding the hinge 27 with the first and second hinge covers 19*c* and 19*d*.

To provide such a configuration, the braking mechanism is configured so that the pressing direction of the brake disk 30 (the direction of arrow D in FIG. 9) is perpendicular to the thickness of the metal plate (the direction of the thickness C in FIG. 9). The dimension E in FIG. 9, which is an important dimension in determining the braking force, can be managed using the drawing accuracy in press working, contributing to the stabilization of the braking force. Incorporating a bending process would decrease the accuracy of the dimension E. Therefore, the C-shaped pressure member may be formed only by the drawing process as in the present embodiment.

The present embodiment employs a general galvanized steel plate as the material of the brake disk 30.

A necessary braking force can be adjusted by optimizing the brake disk 30 according to the size or weight of the opening and closing cover 19. If a sufficient braking force is not obtained, two metal plates may be used as in the present embodiment, or the thickness or shape of the metal plate may be changed. Furthermore, a high-strength material (a stainless steel spring material or a high-tensile steel plate) may be used.

The operation of the braking mechanism will be described hereinbelow.

Figure 10:
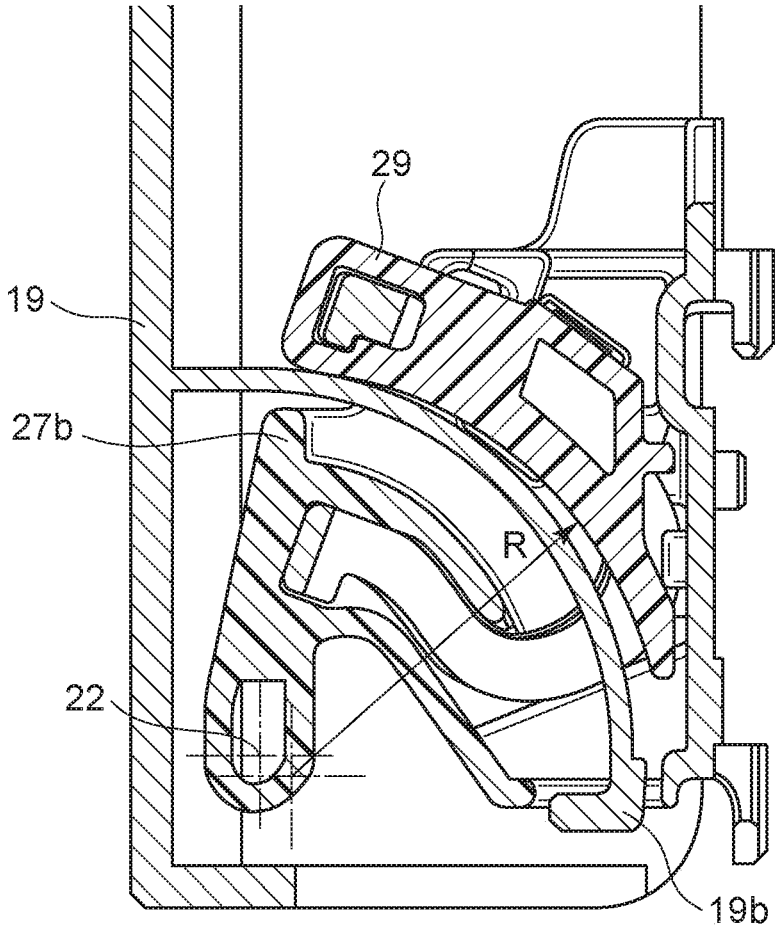
FIG. 10 is a cross-sectional view of the door hinge according to the first embodiment in a state in which the opening and closing door is closed.

FIG. 10 illustrates a cross-section of the door hinge 27 (a cover support portion) in a state in which the opening and closing door 19 is closed with respect to the image forming apparatus. The cross-section in FIG. 10 includes the rotational direction of the opening and closing door 19, or the direction of the turning radius of the opening and closing door 19.

In a state in which the opening and closing door 19 is closed, the door protrusion 19*b* of the opening and closing door 19 is not pressed by the door hinge left frame 27*c* and the brake cover 29 (the clamping portion of the cover support), so that no braking force acts on the opening and closing door 19. If a braking force always acts on the opening and closing door 19, the opening and closing door 19 is prone to bias closing, and a large closing force is required.

Figure 11A:
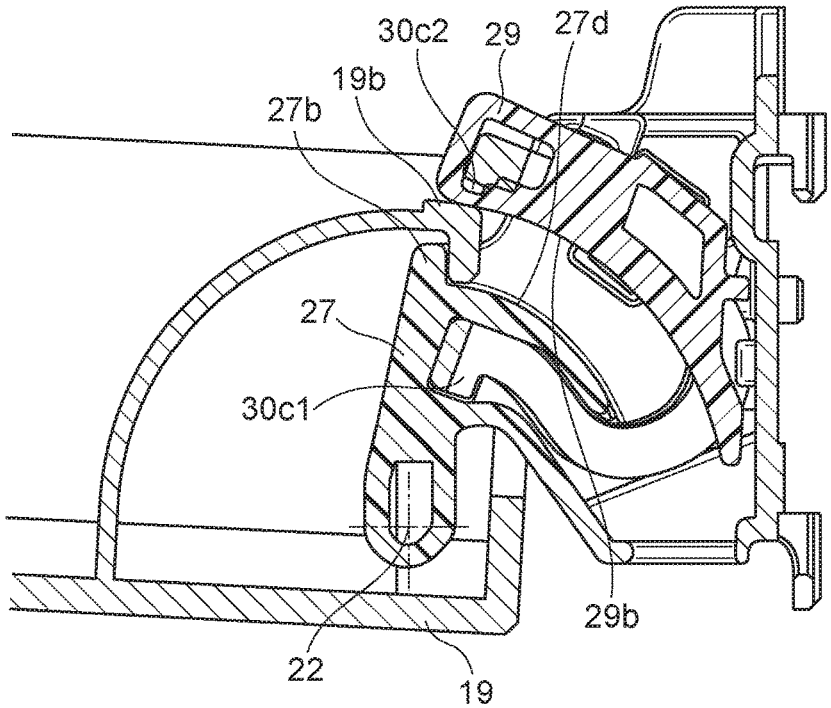
FIG. 11A is a cross-sectional view of the door hinge according to the first embodiment in a state in which the opening and closing door is open.

FIG. 11A illustrates a cross-section of the left door hinge 27 when the opening and closing door 19 is fully opened. The cross-section in FIG. 11A includes the rotational direction of the opening and closing door 19, or the direction of the turning radius of the opening and closing door 19.

In a state in which the opening and closing door 19 is fully opened, the rib on the back of the door protrusion 19*b* is hooked by a door stopper 27*b* of the left door hinge 27 to retain the opening and closing door 19.

The braking mechanism is configured so that a braking force acts on the way the opening and closing door 19 opens from the state in FIG. 10 to the state in FIG. 11A. For that purpose, a cover sliding surface 29*b* of the lower surface of the brake cover 29 is an arc with a radius R whose center is offset from the rotation axis 22 of the opening and closing door 19. A hinge sliding surface 27*d* of the door hinge left frame 27*c* presses the door protrusion 19*b* pressed by the cover sliding surface 29*b* while supporting the door protrusion 19*b* from the back. In other words, the clamping portion (the door hinge left frame 27*c* and the brake cover 29) is pressed from both sides by the brake disk 30 (the pressure member) such that the door protrusion 19*b* of the opening and closing door 19 is pressed by the hinge sliding surface 27*d* of the door hinge left frame 27*c* and the cover sliding surface 29*b* of the brake cover 29.

Figure 11B:
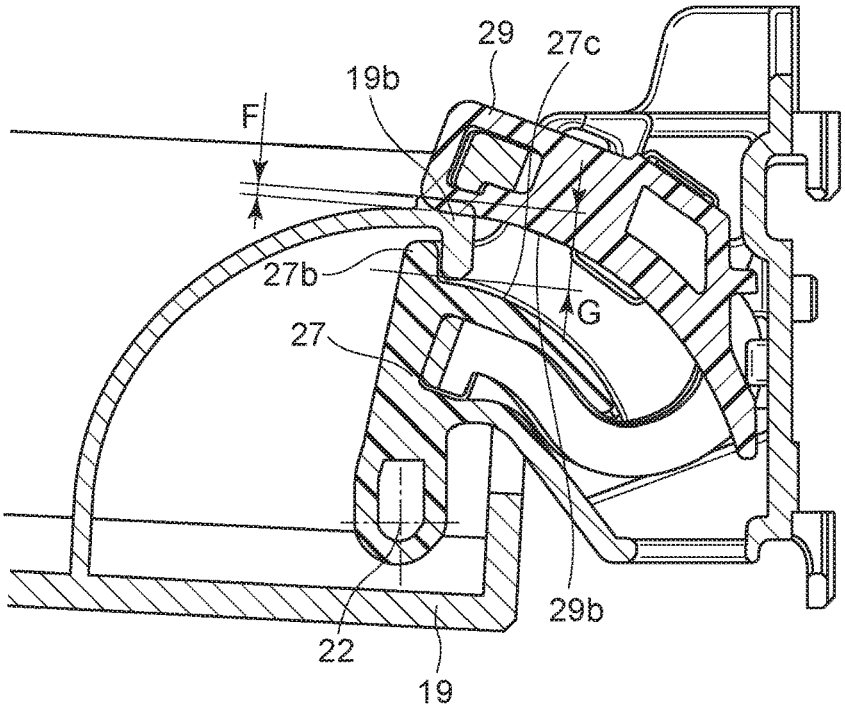
FIG. 11B is a cross-sectional view of the door hinge according to the first embodiment in a state in which the opening and closing door is open illustrating the amount of interference.

FIG. 11B is a schematic diagram illustrating the interference between the door protrusion 19*b* and the cover sliding surface 29*b*. The cross-section in FIG. 11B includes the rotational direction of the opening and closing door 19, or the direction of the turning radius of the opening and closing door 19. In the present embodiment, the interference is started from a state in which the opening and closing door 19 is opened at 45°. In a state in which the opening and closing door 19 is fully opened, the braking force is applied by the amount of interference, F, illustrated in FIG. 11B.

Actually, in a state in which the opening and closing door 19 is fully opened, the brake disk 30 is expanded to move the brake cover 29 into the state in FIG. 11A.

Thus, a braking force during the operation of the opening and closing door 19 can be generated by clamping the door protrusion 19*b* with the cover sliding surface 29*b* and the hinge sliding surface 27*d* using the pressing force of the brake disk 30 (the pressure member). In the present embodiment, the braking force is generated in the latter half of the rotation of the opening and closing door 19 from the closed state to the opened state. However, this configuration is given for mere illustrative purposes. For example, the braking force may be generated in the latter half of rotation to the closed state opposite to that of the present embodiment. The braking force may be generated at two positions immediately before the opening and closing door 19 is fully opened and immediately before the opening and closing door 19 is completely closed.

To provide a stable braking force, it is necessary to manage the amount of interference, F, between the cover sliding surface 29*b* and the door protrusion 19*b* illustrated in FIG. 11B. The amount of interference, F, of the present embodiment is determined by the size E of the brake disk 30, the thickness of the cover sliding surface 29*b*, the thickness of the hinge sliding surface 27*d*, and the distance G from the door protrusion 19*b* to the back rib. This allows the amount of interference, F, to be managed at the positions where the dimensional accuracy can be improved, minimizing variations to provide a stable large braking force. The pressurization using metal brake disks provides a braking force that is not influenced by environmental changes.

As described above, the present embodiment provides a braking mechanism that provides a large braking force with stability without generating a high stress on the door hinge (the clamping portion of the cover support). Since the present embodiment uses no link mechanism and no damper mechanism for the hinge of the opening and closing door 19, a compact braking mechanism can be disposed around the rotation axis of the opening and closing door 19. This allows an image forming apparatus that looks well when the door is opened to be provided at low cost.

In the present embodiment, the brake disk 30 is disposed at the hinge of the opening and closing door 19 of the apparatus main body 1. The same advantageous effects can be provided also in a configuration in which the brake disk 30 is disposed at the opening and closing cover. In other words, the clamping portion and the pressure member may be disposed on the opening and closing door side.

Second Embodiment

Since the configuration of the apparatus main body of the image forming apparatus according to a second embodiment is the same as that of the first embodiment, and only the configuration of the left door hinge differs, the difference from the first embodiment will be described.

When the braking force necessary for improving the operational feeling of the opening and closing door is smaller than that in the first embodiment, the braking mechanism can be further simplified.

Figure 12:
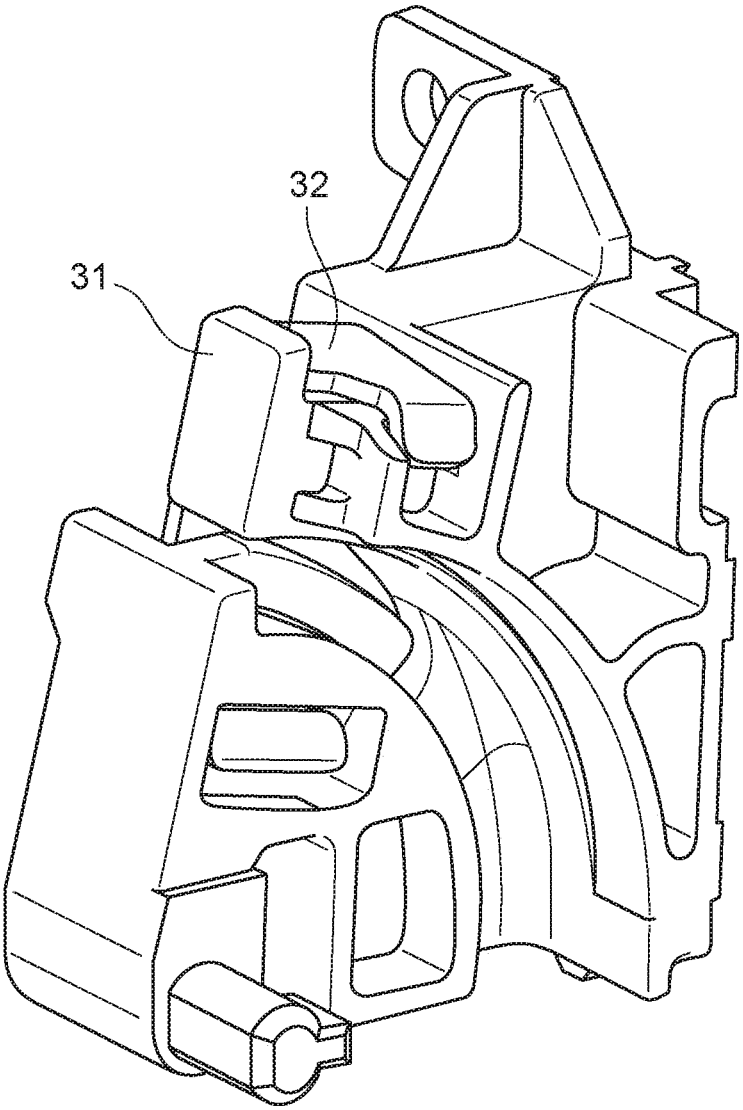
FIG. 12 is a detailed view of a door hinge according to a second embodiment of the present disclosure.

FIG. 12 is a detailed view of the door hinge of the present embodiment.

Figure 13:
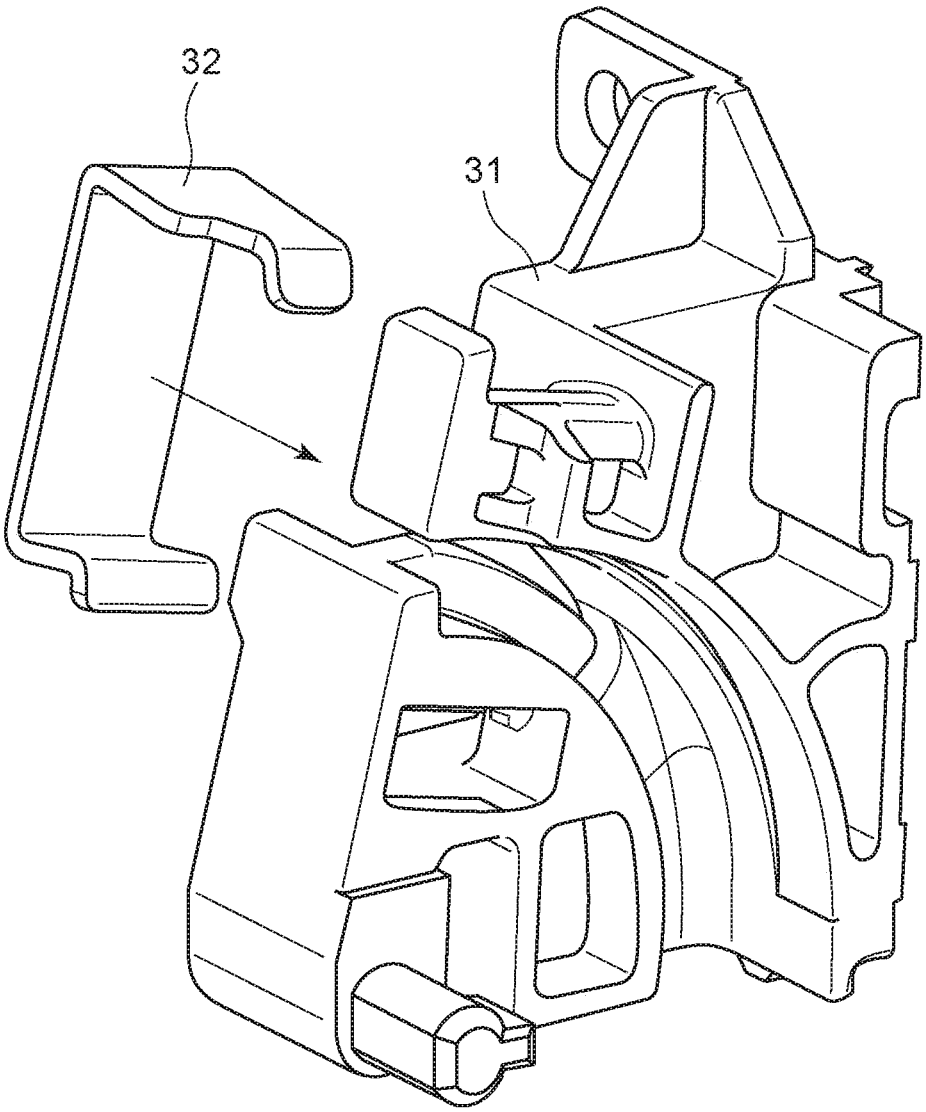
FIG. 13 is an exploded view of the door hinge according to the second embodiment.

As illustrated in the exploded view in FIG. 13, the door hinge of the present embodiment is constituted by two components, in which a pressure plate 32 (a pressure member) is mounted to a door hinge frame 31 (a clamping portion of the cover support). The door protrusion of the opening and closing door is clamped by the door hinge frame 31 in the direction of the turning radius of the opening and closing door, and the outside of the door hinge frame 31 can be contacted by the pressure plate 32 from both sides in the direction of the turning radius. The door protrusion is pressed by the pressure plate (the pressure member) via the door hinge frame 31 (the clamping portion) in the latter half of shifting from the door closed state to the opened state.

Figure 14:
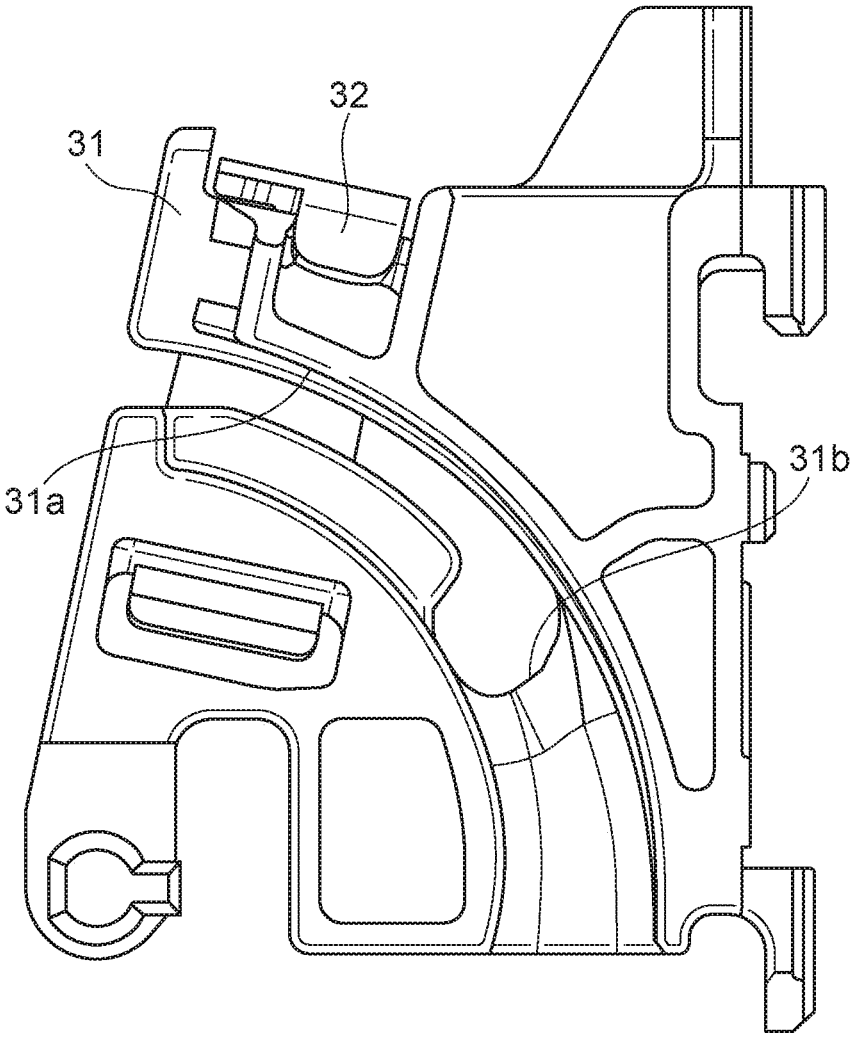
FIG. 14 is a side view of the door hinge according to the second embodiment.
Figure 15:
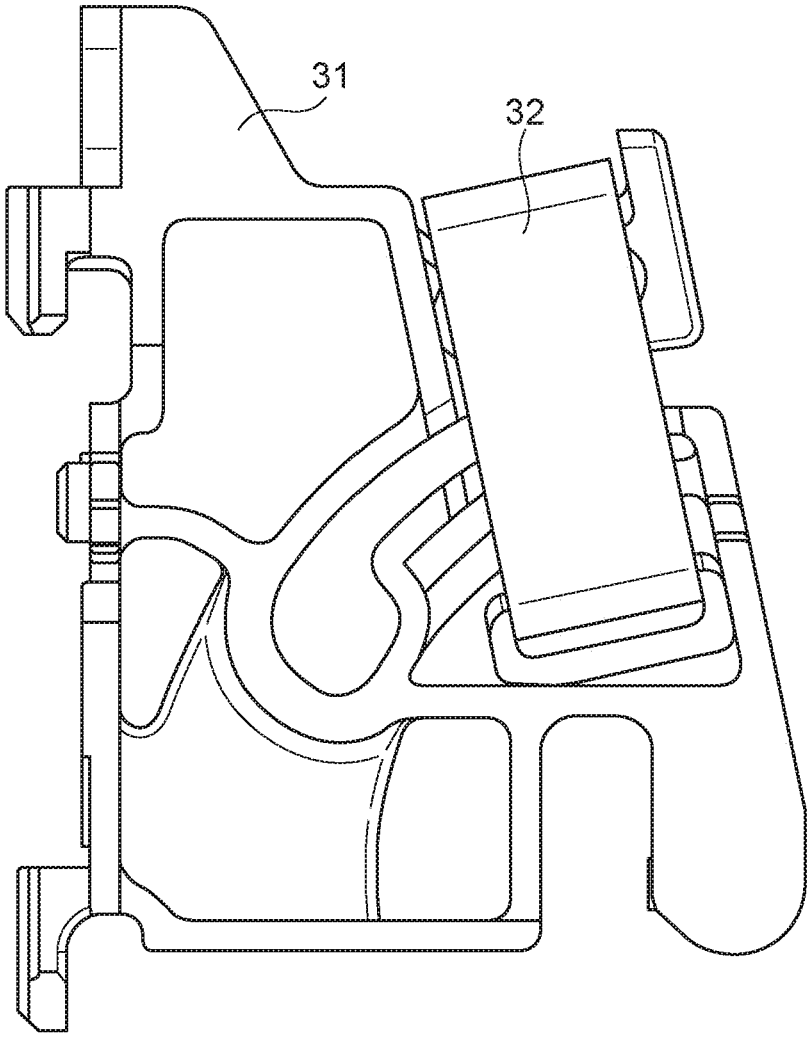
FIG. 15 is a side view (back view) of the door hinge according to the second embodiment.

FIG. 14 is a side view of the door hinge. FIG. 15 is a side view (back view) of the door hinge.

A hinge sliding surface 31*a* in FIG. 14 has an arc shape similar to the cover sliding surface 29*b* of the first embodiment. By making the hinge sliding surface 31*a* interfere with the door protrusion 19*b* of the opening and closing door 19 in the first embodiment, a braking force is generated.

The pressure plate 32 is made of an electrogalvanized steel plate. If the strength is insufficient, a stainless steel spring material or a high-tensile steel plate may be used.

However, since the present embodiment has a simpler configuration than that of the first embodiment, stress concentrates on a notch base 31*b* of the door hinge frame 31. For that reason, the braking force needs to be determined in consideration of the strength of the components of the door hinge.

Furthermore, since the amount of interference varies according to the accuracy of the components of the pressure plate 32 and the door hinge frame 31, the spring constant of the pressure plate 32 needs not to be set higher than necessary.

To obtain a high braking force as in the first embodiment in the present embodiment, the door hinge frame 31 and the pressure plate 32 may be formed by insert molding. This is because the influence of dimensional errors among the components is less than that of an assembly of individually manufactured components.

Thus, the present embodiment provides an image forming apparatus in which the operability of the opening and closing door is improved at lower cost than in the first embodiment, although a large braking force as in the first embodiment is not provided. Of course, the mechanism provides a sufficient braking force using a smaller space than that of the conventional mechanisms.

Third Embodiment

In the present embodiment, the pressure plate 32 of the second embodiment is changed to a pressure spring 34, and the others are the same as those of the second embodiment, and descriptions thereof will be omitted.

Figure 16:
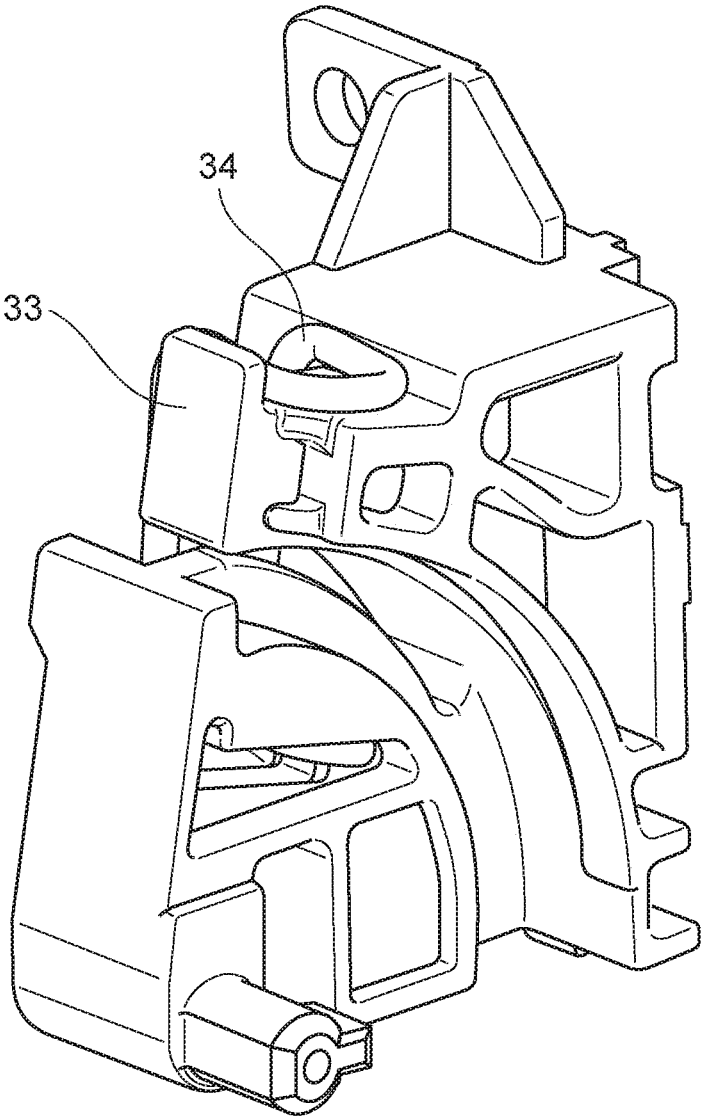
FIG. 16 is a detailed view of a door hinge according to a third embodiment of the present disclosure.

FIG. 16 is a detailed view of the door hinge of the present embodiment.

Figure 17:
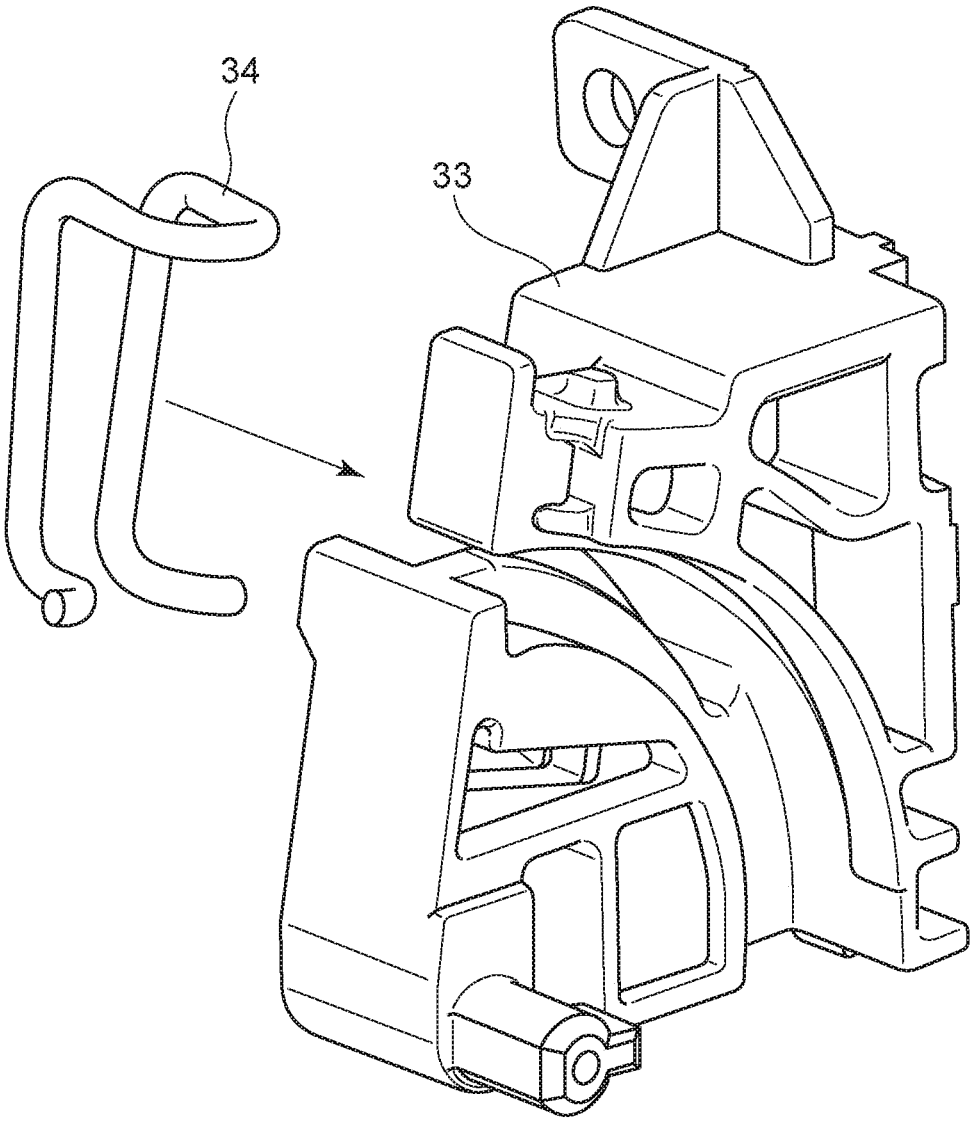
FIG. 17 is an exploded view of the door hinge according to the third embodiment.

FIG. 17 is an exploded view of the door hinge of the present embodiment.

The pressure spring 34 (the pressure member) is multi-formed with a steel wire. The pressure spring 34 is mounted to a door hinge frame 33 (the clamping portion of the cover support) to form the door hinge, as in the second embodiment.

Figure 18:
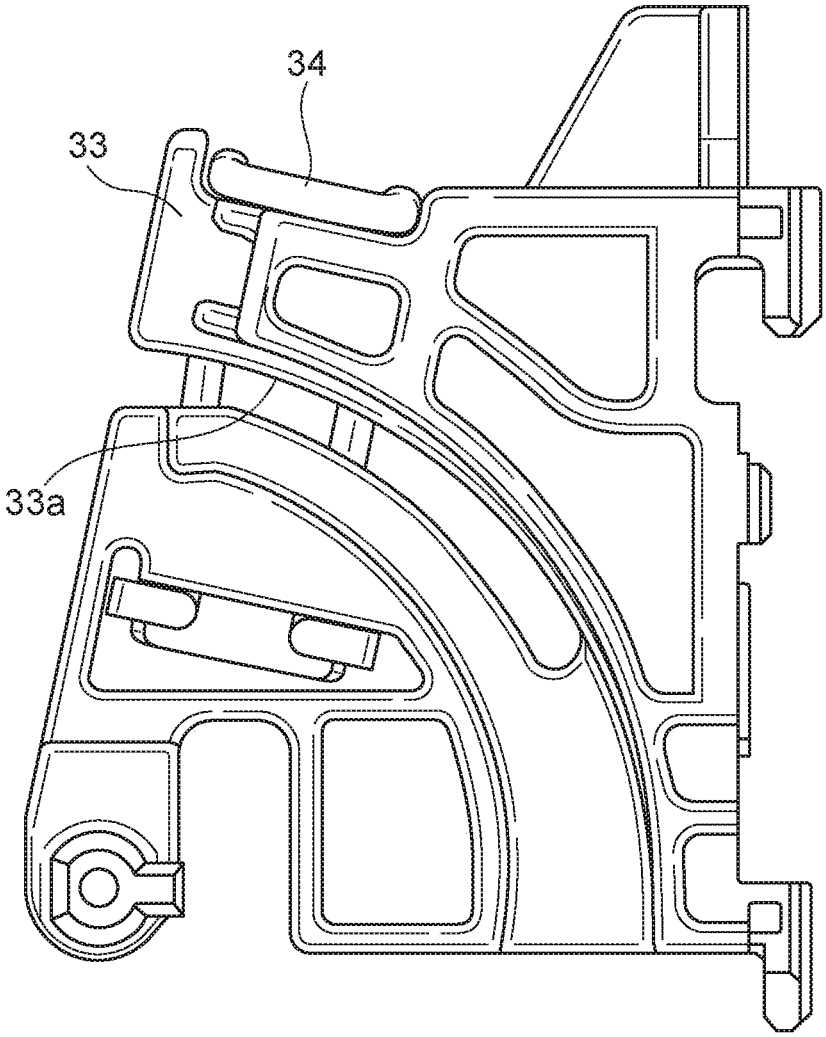
FIG. 18 is a side view of the door hinge according to the third embodiment.
Figure 19:
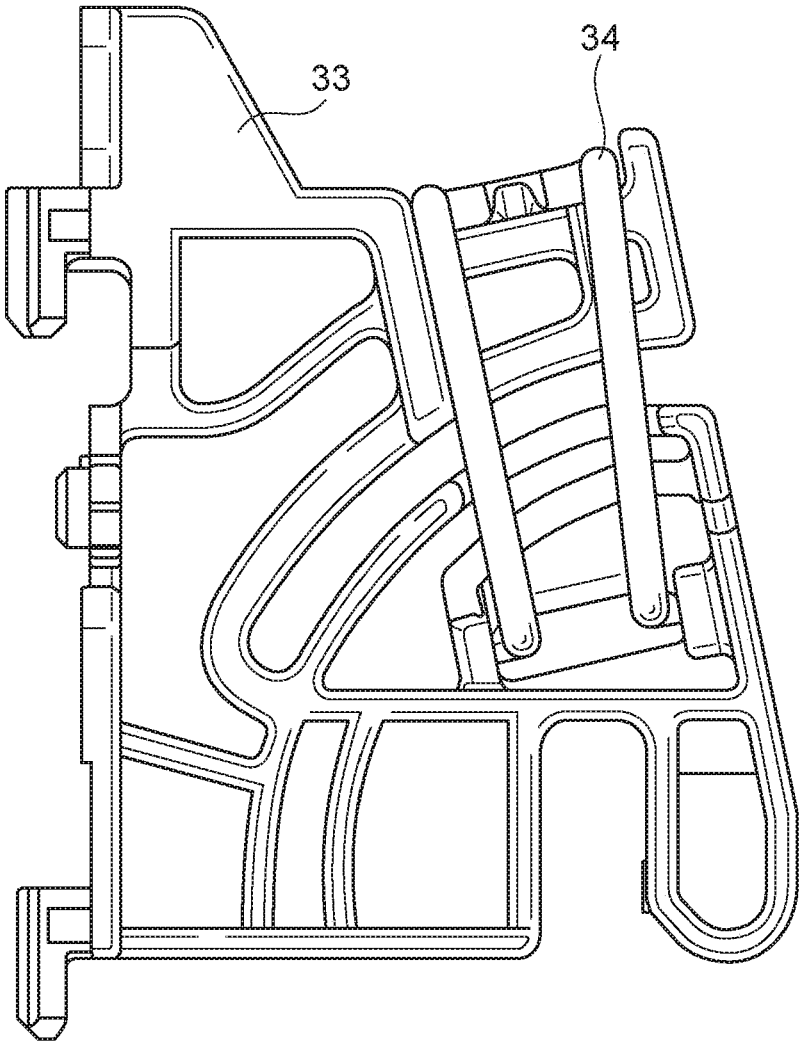
FIG. 19 is a side view (back view) of the door hinge according to the third embodiment.
Figure 20A:
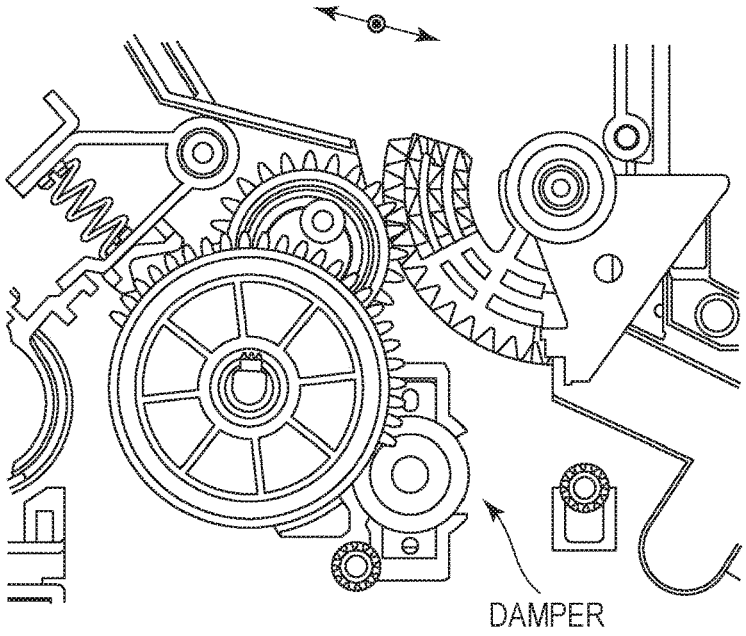
FIGS. 20A and 20B are diagrams illustrating a mechanism provided for a known openable and closable cover.
Figure 20B:
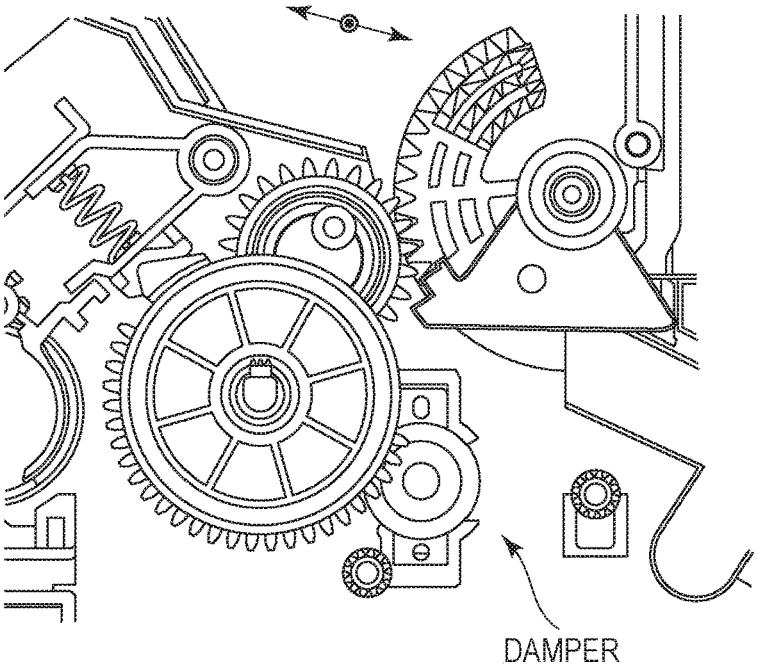
Figure 21A:
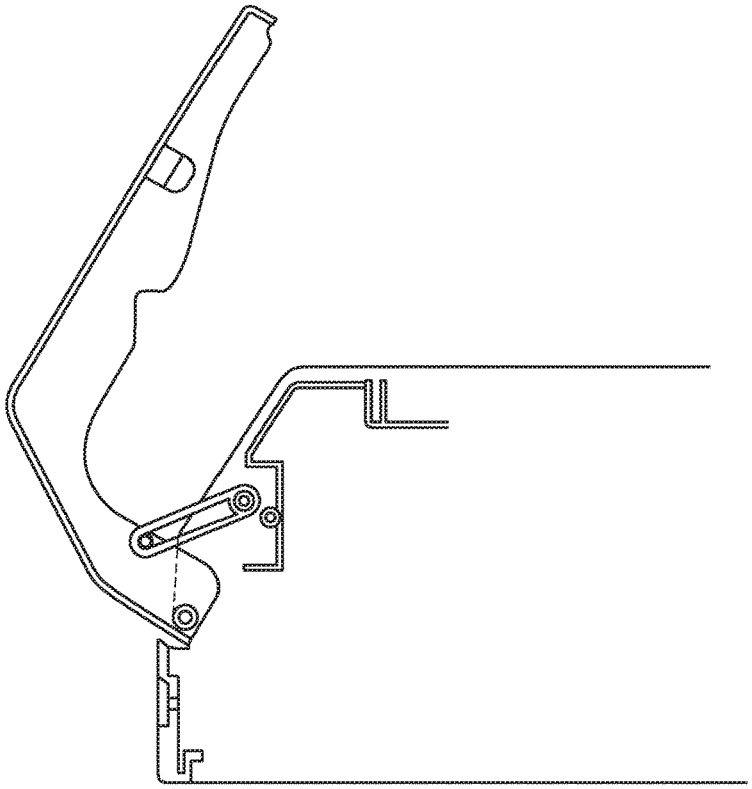
FIGS. 21A to 21C are diagrams illustrating a mechanism provided for a known openable and closable cover.
Figure 21B:
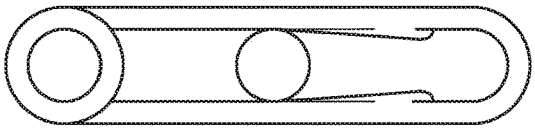
Figure 21C:
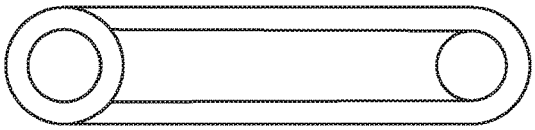
Figure 22C:
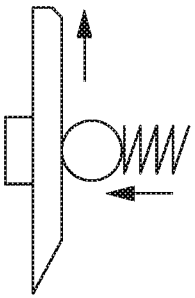
FIGS. 22A to 22C are diagrams illustrating a mechanism provided for a known openable and closable cover.
Figure 22B:
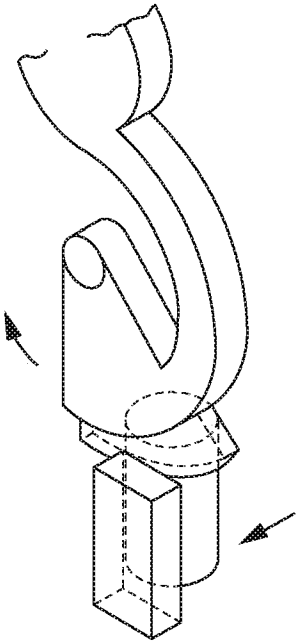
Figure 22A:
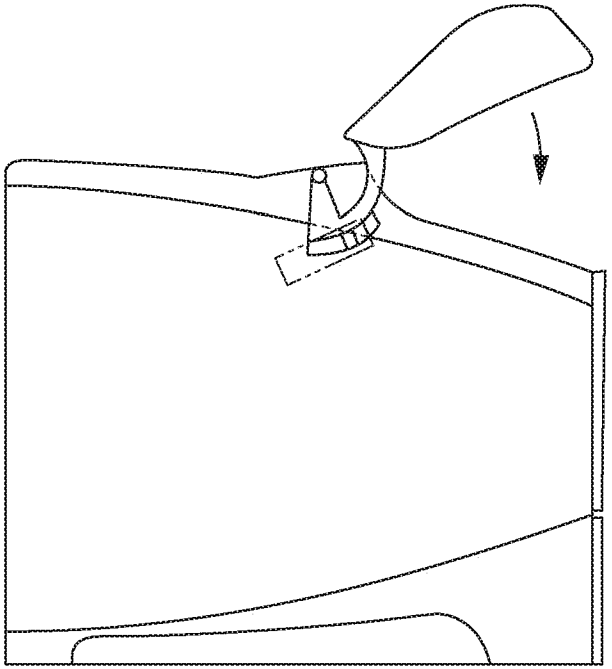

FIG. 18 is a side view of the door hinge. FIG. 19 is a side view (back view) of the door hinge.

The door protrusion 19*b* of the opening and closing door 19 is clamped under pressure by a hinge sliding surface 33*a* and the opposing surface to generate a braking force, thereby providing the same advantageous effects as those of the second embodiment. This mechanism of course provides a sufficient braking force with a smaller space than the conventional mechanisms.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-217750 filed Nov. 10, 2017, and No. 2018-195911 filed Oct. 17, 2018, which are hereby incorporated by reference herein in their entirety.

What is claimed is:

1. An image forming apparatus comprising:

a cover configured to be opened or closed by rotating with respect to the image forming apparatus; and a cover support portion openably and closably supporting the cover on the image forming apparatus, wherein the cover comprises:

a clamping portion configured to contact and clamp part of the cover support portion in a turning radius direction of the cover; and a pressure member mounted to the clamping portion to press the clamping portion, and wherein the pressure member presses the clamping portion so that the clamping portion presses the part of the cover support portion when the part of the cover support portion moves while contacting the clamping portion.

2. The image forming apparatus according to claim 1, wherein the clamping portion comprises a first member and a second member made of resin, wherein the first member and the second member are disposed so as to clamp the part of the cover support portion in the turning radius direction, and wherein the pressure member comprises a first hook to be hooked on the first member and a second hook to be hooked on the second member.

3. The image forming apparatus according to claim 2, wherein the first hook and the second hook are disposed so as to protrude toward a rotation center of the cover.

4. An image forming apparatus comprising:

a cover configured to be opened or closed by rotating with respect to the image forming apparatus; and a cover support portion openably and closably supporting the cover on the image forming apparatus, wherein the cover support portion comprises:

a clamping portion configured to contact and clamp part of the cover in a turning radius direction of the cover; and a pressure member mounted to the clamping portion to press the clamping portion, and wherein the pressure member presses the clamping portion so that the clamping portion presses the part of the cover when the part of the cover moves while contacting the clamping portion.

5. The image forming apparatus according to claim 4, wherein the clamping portion comprises a first member and a second member made of resin, wherein the first member includes a hole, wherein the second member includes a claw that is to come into engagement with the hole, and wherein the pressure member is mounted to the clamping portion by engagement of the first member and the second member in a state in which the pressure member is clamped in a rotation axis direction of the cover.

6. The image forming apparatus according to claim 4, wherein the clamping portion comprises a first member and a second member made of resin, wherein the first member and the second member are disposed so as to clamp the part of the cover in the turning radius direction, and wherein the pressure member comprises a first hook to be hooked on the first member and a second hook to be hooked on the second member.

7. The image forming apparatus according to claim 6, wherein the first hook and the second hook are disposed so as to protrude toward a rotation center of the cover.

8. The image forming apparatus according to claim 4, wherein the clamping portion is made of resin, and wherein the pressure member is made of metal.

9. The image forming apparatus according to claim 4, wherein the clamping portion does not press the cover in a state in which the cover is closed.

10. The image forming apparatus according to claim 4, wherein the pressure member comprises a metal plate, wherein a pressing direction in which the clamping portion is pressed and a thickness direction of the metal plate are perpendicular to each other.

11. The image forming apparatus according to claim 4, wherein the pressure member has a C-shape viewed from a plane perpendicular to a rotation axis of the cover.

* * * * *